US011017992B2

(12) United States Patent
Walker et al.

(10) Patent No.: US 11,017,992 B2
(45) Date of Patent: May 25, 2021

(54) AC-COUPLED SYSTEM FOR PARTICLE DETECTION

(71) Applicant: Agilent Technologies, Inc., Santa Clara, CA (US)

(72) Inventors: Richard C. Walker, Santa Clara, CA (US); David Deford, Santa Clara, CA (US); David Kaz, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 16/567,105

(22) Filed: Sep. 11, 2019

(65) Prior Publication Data

US 2021/0074534 A1 Mar. 11, 2021

(51) Int. Cl.
*H01J 49/02* (2006.01)

(52) U.S. Cl.
CPC ..... *H01J 49/025* (2013.01)

(58) Field of Classification Search
CPC .... A61N 1/36125; H01H 47/22; H01H 83/04; H01J 49/40; H03H 7/004; H03H 7/0138; H03H 7/383
USPC ..... 250/281, 283, 299
See application file for complete search history.

(56) References Cited

U.S. PATENT DOCUMENTS 3,667,030 A * 5/1972 Gordon ..... G05F 1/445 323/319
4,839,602 A 6/1989 Pletcher
9,048,654 B2 * 6/2015 Divan ..... H02H 9/001
9,590,583 B2 * 3/2017 Mazlouman ..... H01P 11/001
2012/0154972 A1 * 6/2012 McMahon ..... H01H 83/04 361/187
2012/0293192 A1 11/2012 Lapington
2014/0214118 A1 * 7/2014 Greiner ..... A61N 1/3756 607/45
2016/0380609 A1 12/2016 Mazlouman et al.

OTHER PUBLICATIONS

International Search Report, PCT App. No. PCT/US2020/050324, dated Nov. 20, 2020, 3 Pages.
Written Opinion of the International Searching Authority, PCT App. No. PCT/US2020/050324, dated Nov. 20, 2020, 4 Pages.

* cited by examiner

*Primary Examiner* — David A Vanore
(74) *Attorney, Agent, or Firm* — Shami Messinger PLLC

(57) ABSTRACT

A system and method for detecting energetic particles include a detector onto which the particles are impinged. An output signal from the detector, indicative of the energy of the particles, is directed by an AC-coupler to a measurement device to determine particle characteristics such as mass and/or abundance. The detector is selectively couplable to positive or negative bias voltages, and in one embodiment is differentially biased to eliminate ringing due common-mode excitation. The AC-coupler has capacitively-coupled input and output terminals that are embedded in a transmission line structure including capacitances that in some embodiments serve as the sole energy storage component in order to reduce the effects of parasitic inductance found in conventional detection circuits. In some embodiments, a pulse compensation network is provided, to reduce undershoot and ringing due to remote installation of the AC-coupler caused by reflection of low frequency components blocked by the AC-coupler.

20 Claims, 9 Drawing Sheets

AC-COUPLED SYSTEM FOR PARTICLE DETECTION

TECHNICAL FIELD

The present disclosure relates generally to mass spectrometers.

BACKGROUND

Certain known time-of-flight (TOF) mass spectrometers operate by accelerating a pulse of ionized molecules with mass m through an electrical field E and detecting the velocity of the accelerated molecule by measuring the propagation delay of the molecules after having transited through a known distance in a field-free region. For a given ionization charge z, the velocity of the accelerated molecule varies as the square root of m/z. This variation in transit time allows a system to be built for analyzing both the mass and the abundance of each of the components of a complex mix of molecules.

Depending on the nature of the molecules being analyzed, it is sometimes helpful to prepare the original molecules as either positively or negatively charged ions. In the most general case, it is desired to build an instrument that can quickly switch between positive and negative ion modes so that the measurement includes properties of both polarities of ions essentially simultaneously on the same sample.

There are several types of detectors that can be used to detect the charged ions. For all types of detectors, it is important that the input to the detector be at the same potential as the field-free region. If the target potential differs significantly from the field-free potential, then the ions will be subjected to an additional acceleration or deceleration, which could compromise the integrity of the timing measurement.

In one non-limiting example, ions in a TOF mass spectrometer are presented to the ion accelerator at approximately 0 volts. For positive ions, the accelerator will subject the ions to a potential of −7000 volts, after which the ions fly freely inside a tube where all the potentials are at −7000 volts to create a field-free environment for the ions to propagate. The detector entry plane is typically either a micro-channel-plate (MCP) or a grid held at −7000 volts.

For negative ions, the acceleration voltage is reversed to positive 7000 volts. In this case, the detector detection plane must also be set to +7000 volts.

The output of the detector is typically transmitted through a 50-ohm cable to an Analog-to-Digital Converter (ADC) that operates with respect to ground.

One class of detector has an output which is electrically isolated from the detection plane. An example of such a detector is a microchannel plate that converts incoming ions to an amplified pulse of electrons which then are accelerated to impact upon a scintillator. The crystal converts the electrons to photons through a fluorescence process. The photons are then collected and passed into a photo-multiplier element to create the final electrical pulse. Because of the conversion to an intermediate optical signal, the output of the photo-multiplier can remain referenced to ground even when the MCP input voltage is dynamically switched from −7000 to +7000 volts.

Another class of detectors are not electrically isolated because they operate with electrons all the way up to the detector output. In such a detector, the output signal changes by +/−7000V when the ion detection polarity is reversed. An example of this type of detector is a combination of an MCP followed by an electron accelerator/focuser followed by a high-speed detection diode. Individual ions are converted to an amplified electron pulse by the MCP, accelerated by an internal +7000 field to higher energy, and then are focused onto the detection diode. The high energy electrons create multiple hole-electron pairs in the diode through a mechanism called "bombardment gain", and are swept out of the diode by a small reverse bias voltage on the order of 300V.

For instruments that measure only positive ions, it is possible to accelerate the ions with −7000 volts, convert them to electrons at the MCP, and then accelerate the electrons with a +7000 volt field for impacting them onto the detection diode. In such a system, the diode output can be safely connected to a ground referenced ADC. However, when switching to negative ion mode, the first acceleration must be +7000 volts. The accelerated ions arrive and create secondary electrons at the MCP. To provide bombardment gain, the secondary electrons must still be accelerated by +7000 volts to the final diode detector. In this case, the diode output will be at +14000 and may no longer be safely connected to ground referenced ADC equipment.

Among available detectors, the second class of non-electrically isolated detectors currently has the fastest available pulse response, in the 500-800 picosecond range for the Full-Width-Half-Maximum (FWHM) pulse width. Detectors in the first, dc-isolated class have a combination of MCP response, scintillator decay time, and photomultiplier response time and typically have pulse widths greater than 1000 picoseconds.

Although capacitor coupling to remove DC offsets is a common circuit technique, it is difficult to implement in a way that does not significantly distort the detected pulse shape. Commonly available ceramic coupling capacitors are limited to about 4 kV in voltage ratings. This means that a coupler required to stand off 14 kV with margin would require 6-8 capacitors in series in both the signal and ground legs of the circuit. Connecting so many capacitors in series produces a large amount of inductance which results in pulse ringing.

U.S. Pat. No. 9,590,583, whose contents are incorporated herein by reference in their entirety, showed how to embed a series combination of capacitors into a 3-dimensional transmission line structure so that the frequency response of the coupler is extremely flat across a high pass portion of the spectrum. This structure, while performing much better than other prior art, still exhibited pulse ringing and echo aberrations in a practical application.

These aberrations are due to three main causes: 1) parasitic inductance internal to the detector charge storage capacitors resonating with the detector capacitance, causing pulse ringing and undershoot, 2) common-mode excitation of the transmission line interconnect ground shield with respect to the surrounding metallic conductors producing delayed reflections that get converted into spurious delayed differential mode signals and 3) differential low frequency components that are not passed by the AC-coupler and are reflected back to the high impedance detector, whereupon they are reflected back into a differential signal as a delayed baseline shift.

In certain embodiments, the disclosure herein modifies the detector bias circuit topology to mitigate some or all of these aberrations.

Single-Ended Detectors

A typical configuration used in the prior art is shown in FIG. 1. A bias voltage source is represented by battery 101. The bias voltage is filtered and current-limited by resistor 102 and capacitor 103 and connected to one terminal of detector 100. The other terminal of detector 100 is connected to the input of a transmission line 104 for transmission to the load resistor 106. The load resistor 106 has a value equal to the impedance of transmission line 104 to prevent any reflections of energy back into the transmission line. In addition, resistor 106 converts the detector current pulse into a voltage 105 for further processing.

In the prior art, it is typical for all voltages to be referenced to a common ground 107.

AC-Coupled System for Dual Polarity Ion Measurement

In an ion detection application such as might be practiced in mass spectrometry, the ion beam will typically terminate on one or another terminal of the current detector 100. In such applications, the voltage of the detection terminal is of critical importance. If the beam is positively charged, then a negatively biased detector will attract and accelerate the particles in the beam. A positively charged detector will repel or decelerate the particles in the beam. In addition, the exact voltage of the detection surface will modify the field in the vicinity of the detector and possibly change the beam focus or the spatial distribution of ions in the beam.

In the prior art, termination resistance 106 is implemented inside a measurement equipment means such as a high-speed oscilloscope which is universally referenced to ground or zero volts. The circuit of FIG. 1 therefore requires that the active detection terminal has a specific voltage determined by the detector bias requirements.

In a dual-ion-polarity mass spectrometry system, it is desired to be able to rapidly switch between positive ions and negative ions. For operator convenience, it is standard practice to connect the ion source to ground potential. If it is desired to measure positive ions, then the beam is attracted and focused towards the detector 100 with a series of ion lenses, each lens in the sequence generally biased with a voltage more negative than its predecessor to successively attract and focus the beam onto the detector. If it is desired to measure negative ions, then the beam is attracted and focused towards the detector 100 with a series of ion lenses, each lens in the sequence generally biased with a voltage more positive than its predecessor to successively attract and focus the beam onto the detector. In such a system, it is typical for the detecting surface of detector 100 to be near −10,000 volts for the detection of positive ions and to be near +10,000 volts for the detection of negative ions.

One approach is to modify the prior art of FIG. 1 to allow the detection surface voltage of detector 100 to be independently varied by plus/minus tens of kilovolts with respect the voltage of termination resistor 106 to accommodate the ion beam transmission voltage requirements for both positive and negative ion generation and detection.

U.S. Pat. No. 9,590,583 partially addresses this problem by using a transmission-line AC-coupler to 1) transmit current pulses with very wide bandwidth and low ringing, and 2) block the DC voltage of the detector from reaching the measurement means 106.

FIG. 2 shows an improved prior art system which allows the voltage of the detection surface of detector 100 to be set independently from the voltage of termination resistor 106 using the AC-coupler of U.S. Pat. No. 9,590,583. Two bias voltage supplies provide control of the voltage at the detection surface of detector 100. Bias generator 201 operates from 0 to 10,000 volts. Bias generator 202 operates from 0 to −10,000 volts. Switch 203 may be set to select either bias generator 201, 202 to allow the detector to operate with either positive or negative ion beams. AC-coupler 200 blocks the detector DC bias voltage from reaching the input resistor 106 of measurement equipment means. Resistor 204 is required to provide a DC return because the AC-coupler blocks current through load resistor 106.

The circuit of FIG. 2 isolates the multi-kilovolt bias voltages 201 and 202 from reaching the detector input resistor 106; however, in actual operation, three different types of pulse aberrations are noticeable:

Aberration 1: storage capacitor inductance resonating with detector capacitance

The first aberration is due to the non-ideality of charge storage capacitor 103 and the detector 100. A simplified form of the circuit of FIG. 2 with more accurate diode and capacitor models is shown in FIG. 3.

Practical capacitors 103 always contain a series parasitic inductance 300. Likewise, practical detectors always have a parasitic parallel capacitance 301. In the case of a diode detector the capacitance term is equal to the parallel combination of diode junction capacitance and diode package capacitance.

The circuit in FIG. 3 models the transient pulse characteristics for a short time after the initial pulse. A detected particle produces an initial current pulse 302, which is followed by undershoot 303 and overshoot 304 caused by the parasitic inductance 300 of capacitor 103 in series with small detector capacitance 301. The ringing period and degree of both damping and overshoot are easily calculated by one skilled in the art based on the parasitic values of the circuit components used.

Because of this ringing defect, particles that arrive shortly after another particle will see their measured amplitude in error by the amount of ringing that overlaps from the preceding particle.

Aberration 2: Common mode excitation of cable converting to differential signal

A second aberration of the prior art is described with reference to FIG. 4. A simplified circuit is shown with sufficient detail for describing the problem. When the detector circuit is floated to +/−10,000 volts, the circuitry is no longer directly connected to ground potential at high frequencies. This is shown schematically by adding resistor 401 to show the output impedance of bias generators 201 and 202. Resistor 401 will typically be in the range of 1-10 mega-ohms for a bias generator in the range of 10,000 volts. Although the detector circuit floats away from ground at a high DC impedance, there is inevitably parasitic capacitance from various nodes to ground 107. For illustration, FIG. 4 shows one such parasitic capacitance 400 associated with the node driving the center conductor of transmission line 104. Although this particular node is chosen for illustration, the problem to be described is similar if an excess capacitance is chosen at some other node.

The transmission line is shown in a cut-away view to emphasize that practical transmission lines support two modes of propagation. The first mode is differential between the current 402 flowing on the inner conductor and the current 403 flowing on the inside of the coaxial shield. The second mode is differential between current 404 flowing on the outside of the coaxial shield and current 405 flowing on the surrounding environmental ground. When detector 100 produces a current pulse Id, some portion of the current Ic is diverted through parasitic capacitor 400. The current delivered to the center conductor is then Id−Ic. Currents on conductors 402 and 403 are purely differential and flow between the inner conductor and the inside of the coaxial shield. The current 403 returning from the inside surface of the transmission line must therefore also be equal to Id−Ic. To establish current balance, the current Ic through parasitic capacitor 400 is forced to flow on the outside conductor of the coax as current 404 with respect to ground 107 and to return through the shared ground as current 405.

For a circuit without an AC-coupler, the ground current loop consisting of current 404 on outer conductor of coax and current 405 returning through environmental ground can be neglected because it flows in a closed loop on the outside of the signal path. The impedance of a typical ground plane is so low that even very high currents only make millivolts of perturbation in the low impedance sea of electrons.

However, in a system with AC-coupler 200, the output of transmission line 104 has an unbalanced output due to the break in the outer shield conductor. AC-coupler 200 is shown with differential transformer 406 to model the fact that it is designed to only support pure differential mode currents. At the input of AC-coupler 200, an initial current pulse produces a center conductor current 407 equal to Id−Ic, but the sum of inner and outer shield currents 408 has a magnitude of Id. The common mode component sees a high impedance at the coupled differential structure 406 and therefore reflects off of AC-coupler 200 and propagates back towards detector 100. When the reflected wave arrives a portion of it is converted back into a differential signal by parasitic capacitor 400 which reflects off the high impedance of the detector, producing an echo 411 delayed by the round-trip propagation of the original pulse through transmission line 104. Depending on the degree of circuit imbalance, only a portion of the wave is converted to differential mode. The remaining common-mode component will also reflect again, producing a second echo 412. In practice, this defect causes an exponentially decaying train of echo pulses for every detection event.

Aberration 3: Differential mode reflection at low frequencies causes ringing when AC-coupler is installed remotely, or when the AC coupler itself has a large enough extent to cause a delay that is not short compared with the transmitted pulse width.

With reference to U.S. Pat. No. 9,590,583, it is possible to produce an AC coupler that has an accurate impedance Z0 (typically in the region of 50 ohms), that is flat across a high frequency band. However, by definition, an AC coupler must increasingly block frequencies below a defined cut-off frequency.

This loss of low frequency components causes several aberrations in the system. Firstly it introduces a tilt in the step response of the AC-coupler, or equivalently, a baseline offset in the impulse response which exponentially corrects with a time constant inversely proportional to the AC-coupler's cutoff frequency. This behavior is standard for any AC-coupler and can be mitigated to some extent by making resistor 204 as large as possible to increase the circuit time-constant. Secondly, a more troubling problem occurs when the AC-coupler is installed some distance from the detector using transmission line 104. FIG. 5 shows a simplified single-ended equivalent circuit that illustrates the problem.

When transmission line 104 is zero length, a typical AC-coupled waveform 500 is transmitted through to termination 106. When transmission line 104 is set to a length such that the transmission line delay is larger than the detector pulse width, waveform 501 results. As the delta pulse current propagates to the output, it charges the capacitance in AC-coupler 200. This voltage subtracts from the output signal at node 105 producing undershoot 502. In addition, the voltage step caused by the charging of capacitor 200 causes a reflection on the transmission line. After a time equal to the transmission line 104 propagation time, the positive voltage step reflected from capacitor 200 arrives back at high impedance detector 100. The positive pulse then doubles in voltage and reflects back to the load. After a time equal to twice the transmission line 104 delay, the positive pulse 503 arrives back at the load, partially resetting the initial undershoot of the signal. Of course, the reflected pulse also charges capacitor 200, producing a second reflection, leading to rapidly converging exponentially decaying cascade of exponential steps.

OVERVIEW

Described herein are a system and method for detecting particles, including a detector unit having a differentially-biased detector with a first terminal for coupling to a positive bias voltage and a second terminal for coupling to a negative bias voltage, and an AC-coupler for coupling the detector to a measurement device, the AC-coupler having capacitively-coupled input and output positive terminals and capacitively-coupled input and output negative terminals. In certain embodiments, the capacitive couplings of the input and output positive and negative terminals are embedded in a transmission line structure with a differential impedance Z0, the input positive terminal is coupled to the first terminal of the detector, and the input negative terminal is coupled to the second terminal of the detector.

In certain embodiments, the capacitive couplings of the input and output positive and negative terminals of the AC-coupler are the sole detector energy storage component.

In certain embodiments, a pulse compensation network connected in parallel with the detector is included.

Also described herein are a system and method for detecting particles, including a detector having a first terminal for coupling to a positive bias voltage and a second terminal for coupling to a negative bias voltage, and an AC-coupler for coupling the detector to a measurement device, the AC-coupler having capacitively-coupled input and output positive terminals and capacitively-coupled input and output negative terminals. In certain embodiments, the capacitive couplings of the input and output positive and negative terminals are embedded in a transmission line structure with a differential impedance Z0, the input positive terminal is coupled to the first terminal of the detector, the input negative terminal is coupled to second terminal of the detector, and the capacitive couplings of the input and output positive and negative terminals of the AC-coupler are the sole detector energy storage component. In certain embodiments, a pulse compensation network connected in parallel with the detector is included.

Also described herein are a system and method for detecting particles, including a detector having a first terminal for coupling to a positive bias voltage and a second terminal for coupling to a negative bias voltage, a pulse compensation network connected in parallel with the detector, and an AC-coupler for coupling the detector to a measurement device, the AC-coupler having capacitively-coupled input and output positive terminals and capacitively-coupled input and output negative terminals. In certain embodiments, the capacitive couplings of the input and output positive and negative terminals are embedded in a transmission line structure with a differential impedance Z0, the input positive terminal is coupled to the first terminal of the detector, and the input negative terminal is coupled to second terminal of the detector.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

The following description is illustrative only and is not intended to be in any way limiting. Other embodiments will readily suggest themselves to those of ordinary skill in the art having the benefit of this disclosure. Reference will be made in detail to implementations of the example embodiments as illustrated in the accompanying drawings. The same reference indicators will be used to the extent possible throughout the drawings and the following description to refer to the same or like items.

In the description of example embodiments that follows, references to "one embodiment", "an embodiment", "an example embodiment", "certain embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. The term "exemplary" when used herein means "serving as an example, instance or illustration." Any embodiment described herein as "exemplary" is not necessarily to be construed as preferred or advantageous over other embodiments.

In the interest of clarity, not all of the routine features of the implementations described herein are shown and described. It will be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

Figure 6:
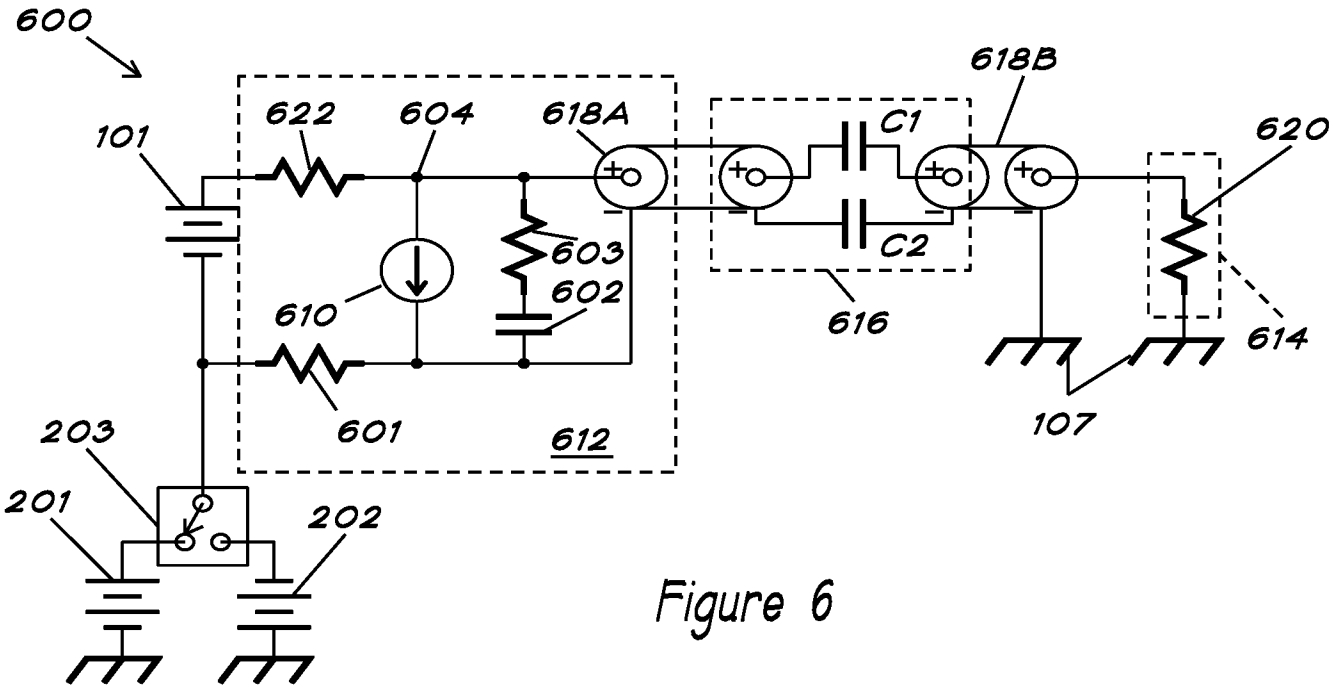
FIG. 6 is a schematic diagram of a system 600 for measuring particles and using differential biasing, pulse compensation, and elimination of a charge storage capacitor in accordance with certain embodiments.

FIG. 6 is a schematic diagram of a system 600 for measuring particles in accordance with certain embodiments. System 600 generally includes a differentially-biased detector 610 to which particles of interest are directed, a measurement device 614 for receiving an output signal of the detector, and an AC-coupler 616 for directing the signal of interest to the measurement device. As an example, applications requiring analysis of particles such as photons, electrons, charged atoms or molecules may use detector 610 to convert the arrival of such particles into an electrical current pulse. The resulting current pulse can then be converted into a voltage which can be digitized and processed at measurement device 614 to extract information about the properties of the particle itself.

The width, area, height and arrival time of the detector current pulse all encode analog properties which are desired to be measured as precisely as possible. Mass spectrometry is an example of such an application in which the current pulse produced by the detector encodes information in both amplitude and time. In a typical system, the arrival time of a pulse encodes the mass/charge ratio of a particle and the amplitude of the current pulse encodes the abundance or number of such particles arriving at a given time. From these two parameters, measurement device 614 can compute the mass spectrum of a chemical sample, giving both the abundance and mass/charge ratio of each chemical compound present in a sample.

Examples of current-output detectors 610 used in such applications include, without limitation, 1) Faraday cup ion detectors that receive a burst of charged particles, converting them into a current flow as a function of time, 2) Photomultiplier devices with multiple dynodes for charge multiplication, 3) Micro-channel plate devices that multiply charge by multiple-hop electron impacts inside a cylindrical bore, and 4) Semiconductor diode devices which may possibly be combined with internal avalanche gain multiplication structures.

Although the description herein uses the semiconductor diode as the exemplary detector, it should be clear to those of ordinary skill in the art that any of the other classes of current detectors could be substituted in the place of the diode detector with substantially similar performance improvements. In the drawing figures, the detector 610 is represented by a generic current-source symbol to make clear that all aspects of the described arrangements can equally well be applied to any detector producing an electrical current pulse output. In addition, although charged ions are described, it should be clear that particles such as photons, electrons, or other particles that impinge upon the detector could also be detected with all the advantages of the techniques described for charged ions.

System 600 as shown includes detector 610 as part of a detector unit 612, coupled to the measurement device 614 using AC-coupler 616, by way of transmission line sections 618A and 618B (collectively 618), which may be a coaxial cable. In this exemplary configuration, AC-coupler 616 has input and output positive terminals that are capacitively coupled to each other, and input and output negative terminals that are capacitively coupled to each other. The coupling capacitances C1 and C2 are embedded in a transmission line structure with a differential impedance of value Z0. It should be noted that while represented as a pair of capacitances C1 and C2 in FIG. 600, in certain embodiments each of the capacitances C1 and C2 may be comprised of a single capacitor or multiple capacitors—for example 8 capacitors—distributed into a coupled transmission line. The transmission line sections 618A and 618B are optional, and when not employed, may be referred to as being of zero length for purposes of the discussion and analysis herein. In certain embodiments, one or both transmission line sections 618A, 618B may comprise multiple segments in a series connection. As shown, a first terminal of detector 610 is connected to a positive bias voltage, provided for example by battery 101, and is connected to the positive, inner conductor of section 618A of the transmission line; and a second terminal of detector 610 is connected to a negative bias voltage, provided for example by the battery 101, and is connected to the negative, outer conductor of section 618A of the transmission line. Similarly, the positive, inner conductor of section 618B is connected to load resistor 620 of measurement device 614; and the negative, outer conductor of section 618B is grounded at 107. It will be appreciated the terms "negative" and "positive" are used for convenience to refer to two different voltage levels or components connected to two different voltage levels, and should not be construed as conferring any electrical or structural limitations beyond that.

Figure 1:
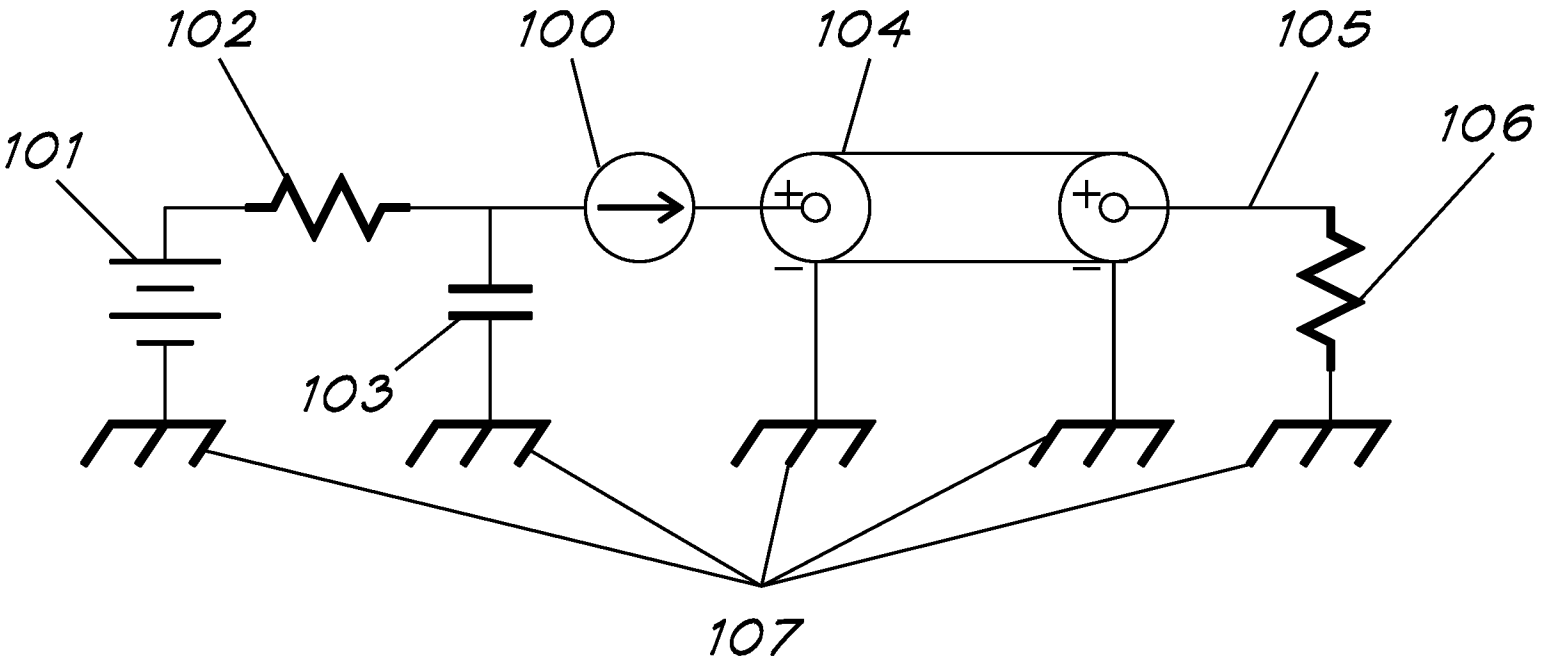
Figure 1 (Prior Art)
FIG. 1 is a prior art single-ended system for detecting particles.

The system 600 reduces or eliminates the pulse defects of the prior art through a combination of topology and component changes. The first prior art problem of ringing due to parasitic inductance of the charge-storage capacitor (103 in FIGS. 1-2) is solved by eliminating the offending charge storage capacitor. Instead, the input capacitance of AC-coupler 616 is used for charge storage. The incorporation of capacitances C1,C2 into the transmission line structure of AC-coupler 616, which in certain embodiments are the sole energy storage component, allows the parasitic inductance to be absorbed into the transmission line. Because the high-pass impedance of the AC-coupler 616 is well-matched to the transmission line impedance of the connecting coax 618 and termination 620, there is no residual inductance to cause overshoot or ringing.

Figure 2:
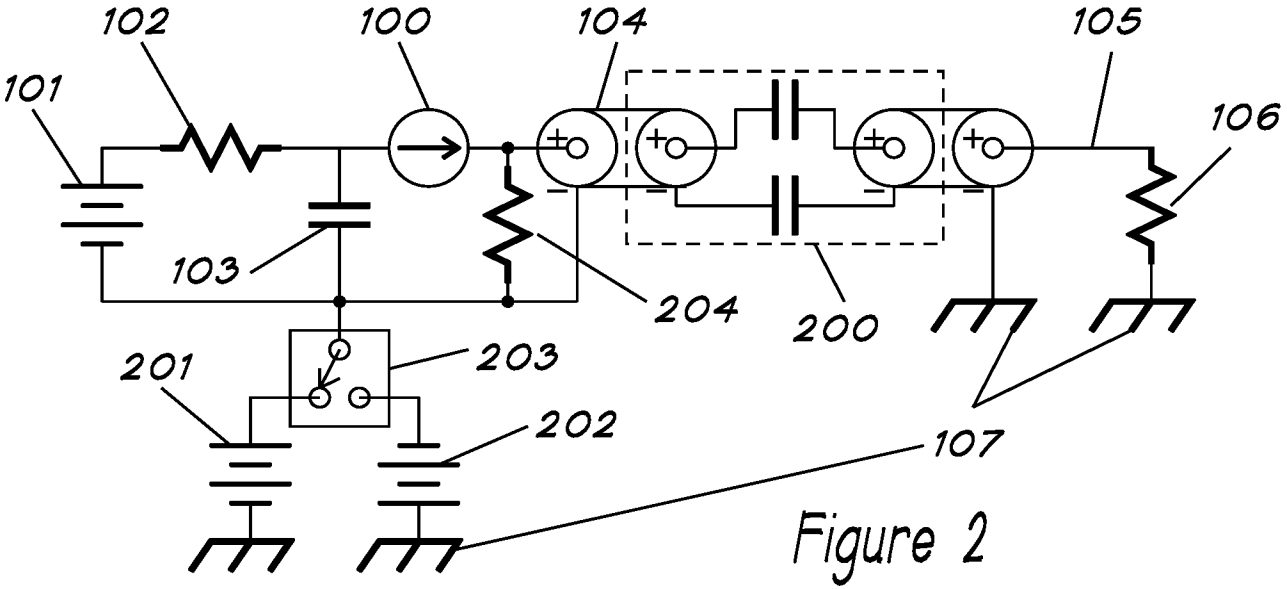
Figure 2 (Prior Art)
FIG. 2 is a prior art AC-coupled system for dual polarity ion measurement.
Figure 3:
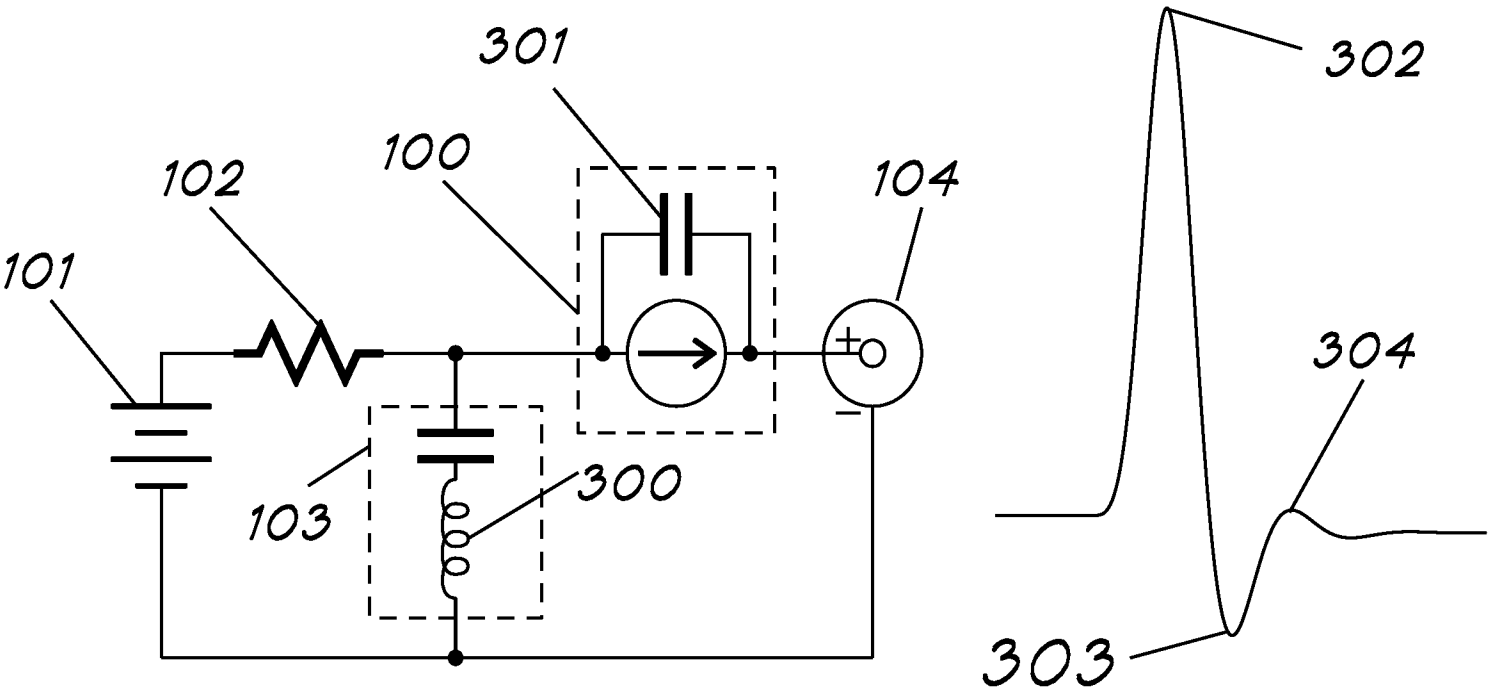
Figure 3 (Prior Art)
FIG. 3 is a simplified form of the prior art circuit of FIG. 2 with more accurate diode and capacitor models depicting ringing due to charge-storage capacitor inductance.
Figure 4:
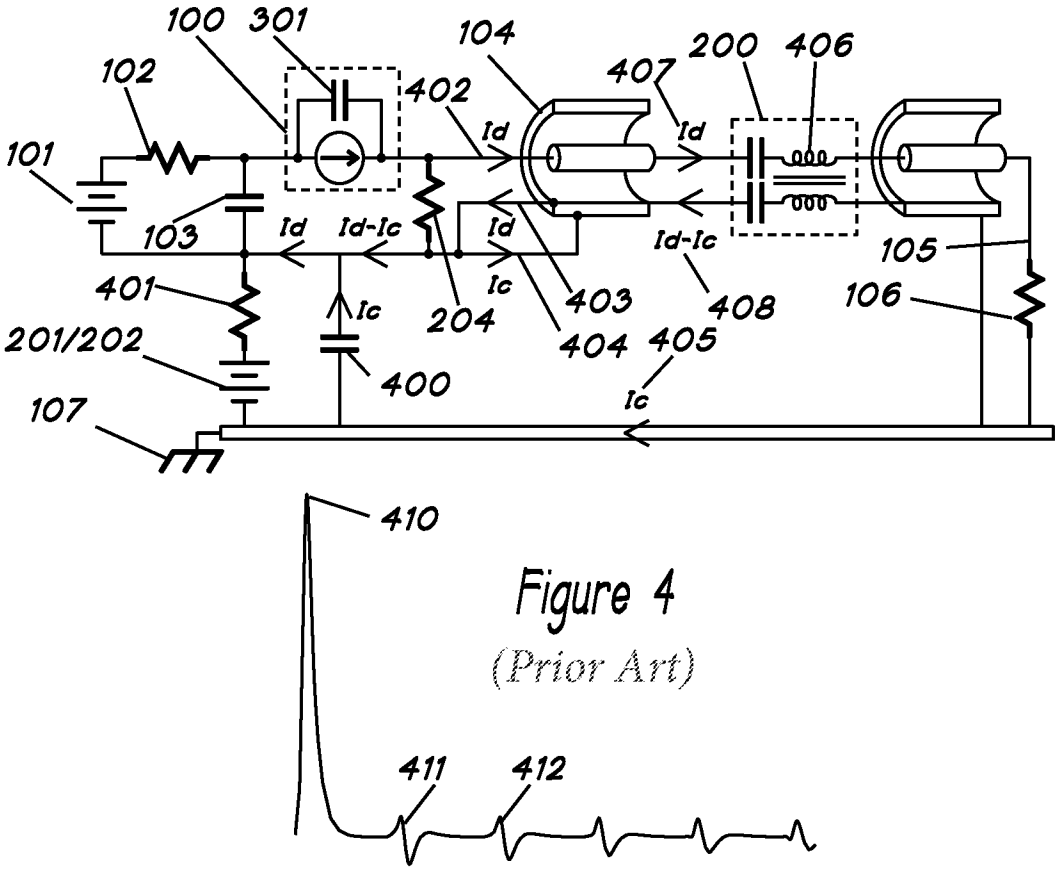
Figure 4 (Prior Art)
FIG. 4 is a simplified circuit problems associated with common mode excitation of cable converting to differential signal in the prior art.
Figure 5:
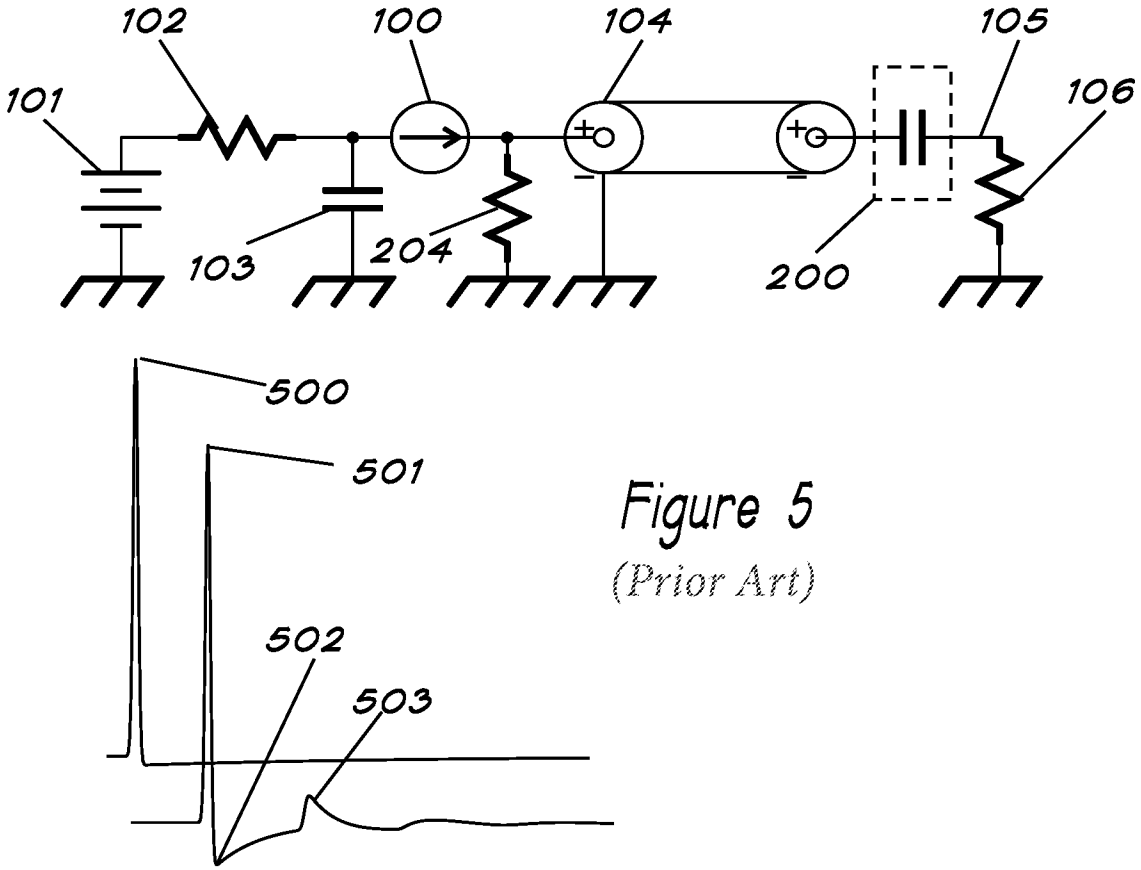
Figure 5 (Prior Art)
FIG. 5 shows a simplified single-ended equivalent circuit that illustrates the problem of reflection from the prior art AC-coupler.

The second prior art problem of common-mode excitation is caused by an imbalance of currents flowing to ground at the two inputs of the transmission line (104 in FIGS. 1-2), as illustrated by parasitic capacitor 301 in FIGS. 3 and 4. The typical cause of a larger capacitance to ground on one node is due to floating a circuit that traditionally connects many components to ground 107. The ground node will comprise a large amount of copper trace area and will include interconnect capacitance of all the distributed components that connect to this node. To eliminate this problem, the detector 610 in system 600 is directly connected to the transmission line 618 (or to optional one or more transmission line connectors, not shown) with minimal interconnect capacitance. All remaining circuit capacitance for voltage sources 201, 202 and selector switch 203 is isolated by using differential biasing provided by resistors 601 and 622. Thus instead of a single biasing resistor 102 (FIGS. 1-2), second resistor 622 is introduced. In the prior art circuit, resistor 102 is generally a low value, set just high enough to provide a protective current limiting effect. In the system 600, the differential biasing function of resistors 601 and 622 also provides the time-constant setting function of resistor 204 (FIG. 2). Resistor 603 does not participate in the recharge time constant because it is in series with a capacitor (602). The DC voltage of the charge storage capacitances C1,C2 are only recharged by resistors 601 and 622. In practice, differential bias resistors 601 and 622 of system 600 will be set to about half the desired value of resistor 204. Resistors 601 and 622 will have large values, in the range of about 10K ohm to 100K ohm, for example. Resistor 603 will for example be equal to the characteristic impedance of transmission line 618*a* or most commonly 50 ohms. In certain embodiments, the transmission line could have a different impedance over a range of 5-300 ohms, but 50 ohms is the impedance at which commercial coax and connectors are easily available. A lower impedance could result in a faster detector pulse because it would make a lower time constant with a diode parasitic capacitance.

It should be noted that the term differential biasing used herein denotes the use of resistors or the like, for example resistors 601, 622, to connect detector 610 to an energy source such as battery 101. A more general definition of the term applicable herein is biasing a device (detector 610 in this example) through nonzero impedances at both terminals, rather than connecting one terminal to a fixed DC voltage, such as ground. The two resistors (601, 622) preferably have equal values to maintain optimum balance in the driving impedances. In the arrangements described herein, much of the benefit may come from the isolating effect of the resistors, even if they are not well matched, since the parasitic capacitances play a large role, and the bias may still be considered "differential," even if it is not balanced. Placement of the resistors as close as possible to the detector further provides additional advantages—for example, reducing stubs on the high-speed nodes. In certain embodiments, in lieu of resistors, use of ferrite materials (or a combination of materials) with sufficient loss at all the frequencies of interest to create an effective common mode choke may be practicable.

The third prior art problem of ringing due to the remote connection of the AC-coupler is solved by a pulse compensation network comprised of the series combination of capacitor 602 and resistor 603. To minimize the ringing of the remote AC-coupler reflections, resistor 603 substantially equals the characteristic impedance of transmission line 618 and termination resistor 620. When the time delay through transmission line 618 is zero, and the sum of resistors 601 and 622 is much larger than the resistance of load resistor 620, then the optimum value of compensation capacitor 602 for canceling the output voltage droop caused by AC-coupler 616 is essentially equal to the series capacitance of the AC-coupler. This value ensures that the voltage drop across AC-coupler 616 matches the drop across compensation capacitor 602, because the circuit branches including these components have equal impedances, and the signal voltages applied across them are equal. When AC-coupler 616 is connected to the drive voltage at node 604 with a non-zero time delay transmission line 618, the rising drive voltage at node 604 is no longer perfectly aligned with the rising voltage drop across the AC-coupler, degrading the error cancellation. Decreasing the value of compensation capacitor 602 speeds up the rise of the drive voltage at 604, significantly improving the time alignment of the compensating voltage with the drop across AC-coupler 616.

In practice, the exact capacitance to minimize ringing is dependent on the length of the transmission line: the longer the transmission line, the more the optimal capacitance must be reduced from the ideal zero-length value. It should be noted that network is not a broadband termination (which typically would set capacitor 602 to an arbitrarily large value). A broadband termination as typically practiced would vitiate the long time-constant properties of the network as set by large-valued bias resistors 601 and 622. Instead, the value of capacitance 602 is precisely chosen to minimize ringing for a specific length of interconnect cable 618. More complex series shunt networks of passive components can be generated to provide higher order compensation; however, the additional circuitry may be difficult to implement without introducing further aberrations, and the simple 2-element shunt network of capacitor 602 and resistor 603 is practicable.

The circuit of FIG. 6 solves the three aforementioned defects in an AC-coupled detector system: 1) Storage capacitor inductance resonating with detector capacitance, 2) Ringing due to common-mode excitation of the coax cable and AC-coupler circuit, and 3) Undershoot and ringing due to remote installation of the AC-coupler caused by reflection of low frequency components blocked by the AC-coupler. It allows a current-source-output particle detector to be used with for example the AC-coupler of U.S. Pat. No. 9,590,583 in dual-polarity mode without introducing ringing artifacts that would destroy the fidelity of the output pulses. In addition, the ability to install the AC-coupler remotely allows the detector to be manufactured separately from the AC-coupler if desired. In addition, when the detector reaches end-of-life, it is not necessary to also replace the AC-coupler, reducing maintenance cost. Alternatively, the AC-coupler could be built into the detector itself to minimize component and cable count.

Thus, as detailed below, the system 600 for measuring particles provides several advantages. One advantage is that it provides an improved mechanism for charge storage capacitance over the prior art. The prior art uses a single capacitor 103 (FIGS. 1-2) with parasitic inductance 300 (FIG. 3) which cause a series resonance between parasitic inductance 300 and detector capacitance 301. The system 600 replaces the single-ended charge storage capacitor 103 with coupled pairs of capacitors C1,C2 in AC-coupler 616. By inductively coupling the capacitors in pairs, it is possible to merge the parasitic inductance into the transmission line such that the system inductance is canceled by the shunt capacitance of the coupled transmission line structure, producing a broadband impedance of Z0 without the ringing or resonance effects of the prior art. As explained above, while represented as a pair of capacitances C1,C2 in FIG. 600, in certain embodiments the capacitors C1,C2 may be comprised of multiple capacitors—for example 8 capacitors—distributed into a coupled transmission line. To prevent the pulse integrity from being distorted by the interconnection wire inductance, the two capacitor chains are incorporated into a differential transmission line such that the parasitic inductance is cancelled by the mutual capacitance and approximating a constant surge impedance equal to the Z0 of the connectors and other cabling.

Another advantage of the system 600 for measuring particles is that it replaces the prior art single-ended bias structure consisting of resistor 102 and charge storage capacitor 103 with a balanced differential bias network consisting of two matched resistors 601 and 622. The matched resistors 601 and 622 isolate the critical nodes of the detector 610 from power supply circuitry and minimize the fringing capacitance of the circuit traces that carry the high speed detection pulse. By minimizing and balancing the parasitic capacitance at the input to the transmission line 618A, the common-mode currents are minimized, which reduces or eliminates echoes and ringing on the received pulse.

Another advantage of the system 600 for measuring particles is that when the AC-coupler 616 is installed remotely from a detector by a non-zero length of transmission line 618, there is potential for substantial ringing on voltage 624 of the termination resistor 620. This is due to the low frequency components of the detector output pulse being blocked and reflected by the high-pass filter characteristics of AC-coupler 616. The pulse compensation network consisting of resistor 603 and capacitor 602 added in shunt across detector 610 substantially reduce the pulse ringing due to this reflection. The pulse compensation network is not a typical broadband termination network that would make capacitor 602 an arbitrarily large value to provide broadband impedance match. Instead, capacitor 602 is specifically tuned to be substantially equal to the series capacitance of AC-coupler 616. When transmission line 618 is zero length, the optimum value for capacitor 602 is exactly equal to the AC-coupler series capacitance. As transmission line 618 is lengthened, the optimum value of capacitor 602 decreases with length, but for practical systems is generally within a factor of two of the optimum zero-length value.

In accordance with certain embodiments, the AC-coupler 616 can be remotely installed from the detector for convenience. In certain embodiments, the AC-coupler 616 can be sourced from a different manufacturer from the detector unit 612.

An important benefit of the system 600 for measuring particles is that it allows the detection surface of the detector 610 to be varied more than +/−1 kilovolt with respect to the measurement means input termination resistor 620. This allows the detection system to be used in mass spectrometers with dynamically switch between positive and negative ion detection modes. This may be accomplished by selective switching of switch 203 between voltage sources 201 and 202, which have opposite polarities.

Figure 7:
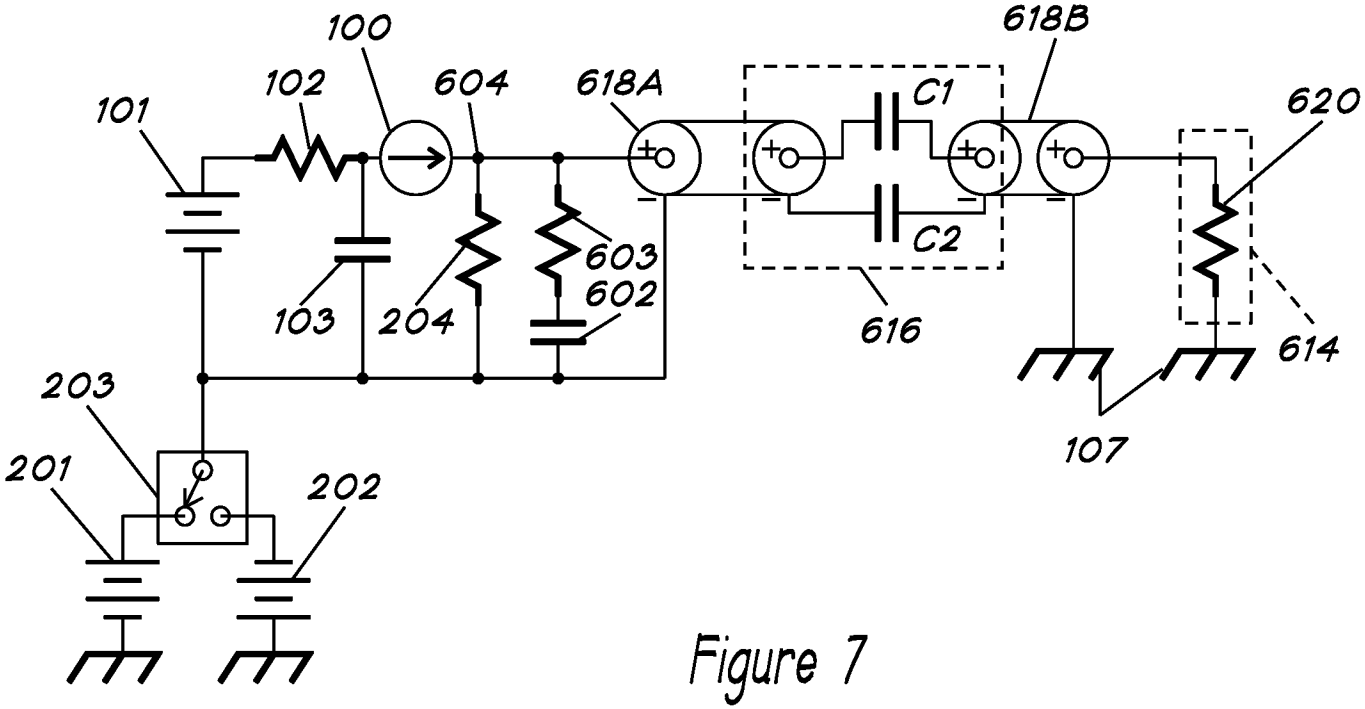
FIG. 7 is a schematic diagram of a system for measuring particles using a compensation network in accordance with certain embodiments.
Figure 8:
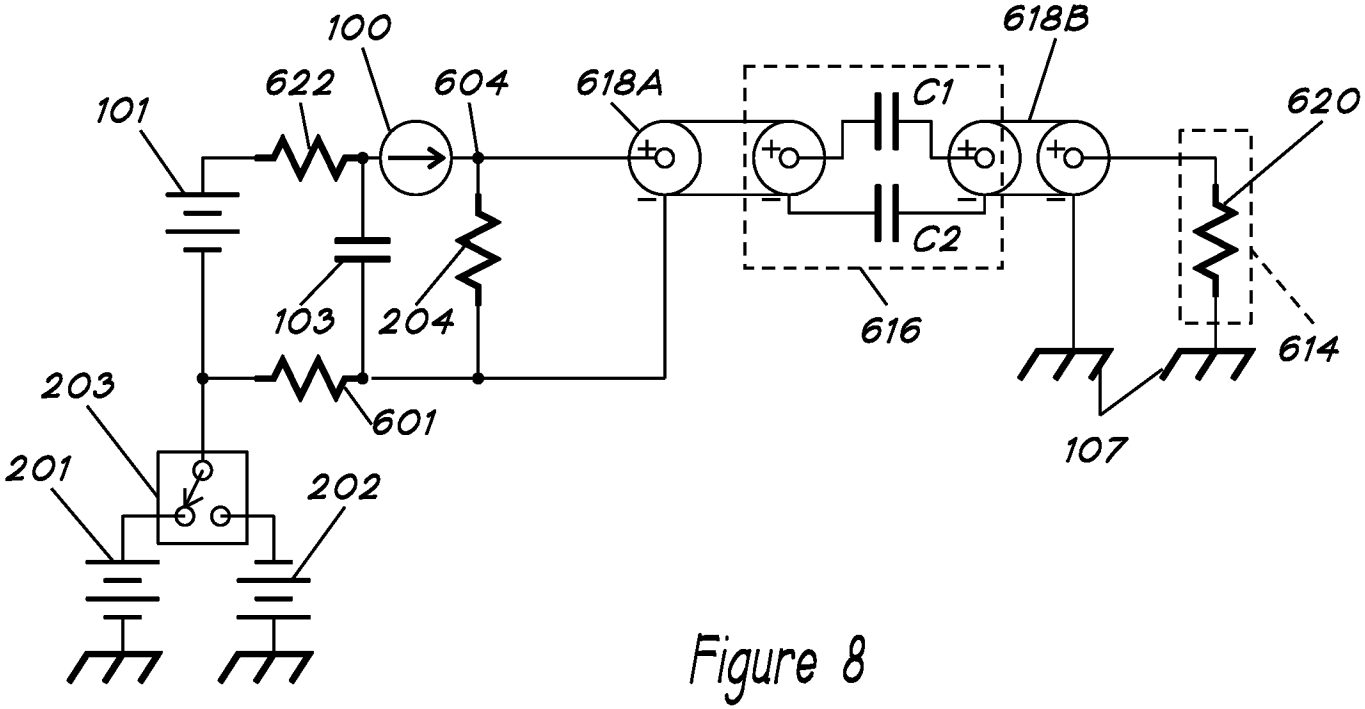
FIG. 8 is a schematic diagram of a system for measuring particles using differential biasing in accordance with certain embodiments.
Figure 9:
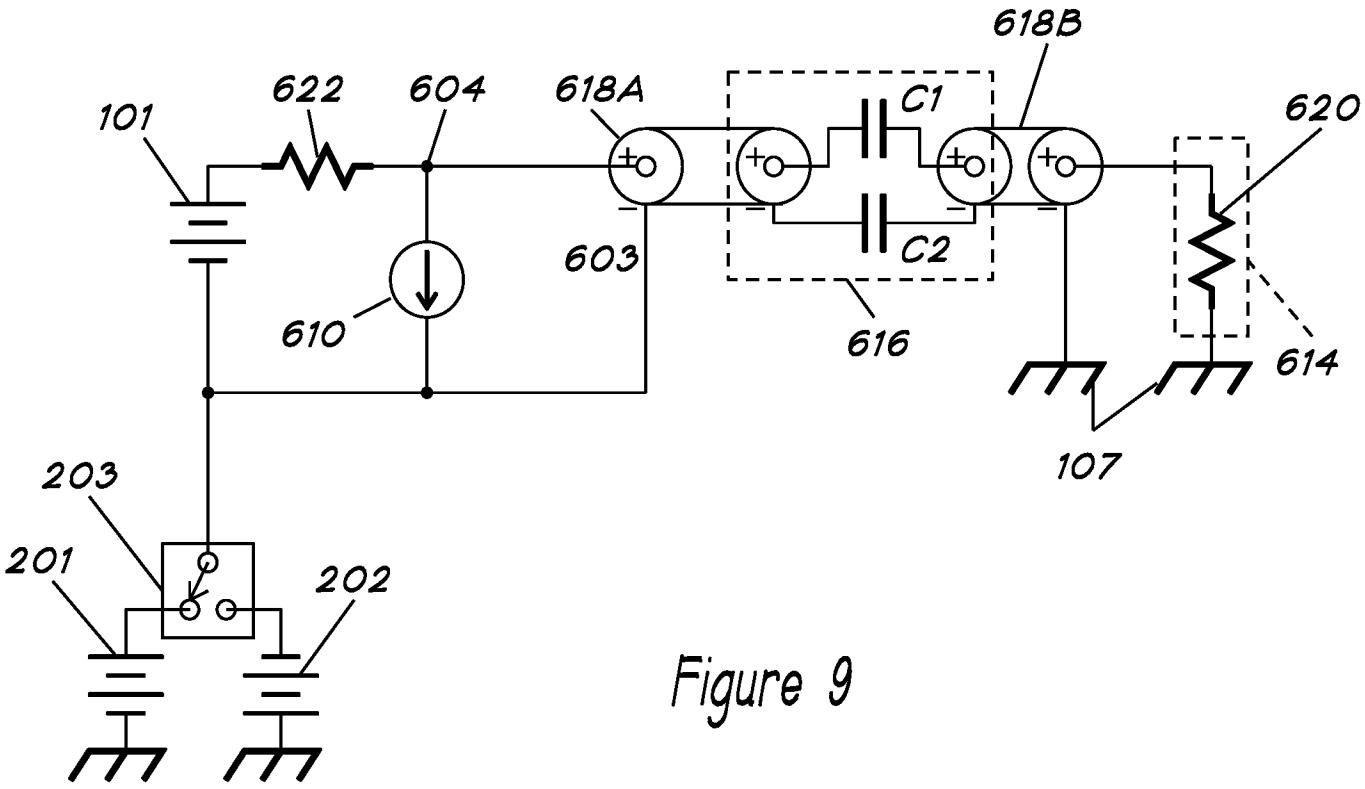
FIG. 9 is a schematic diagram of a system for measuring particles that eliminates the use of a charge storage capacitor in accordance with certain embodiments.

It will be appreciated that the use of the pulse compensation network is independent of differential biasing, and the benefits of the pulse compensation network in eliminating pulse ringing are stand-alone and may be realized without the use of differential biasing. FIG. 7 is a schematic diagram illustrating such use of a pulse compensating network, comprising capacitor 602 and resistor 603. In other respects the circuit of FIG. 7 is substantially similar to that of FIG. 6 described above. Similarly, it will be appreciated that in certain embodiments differential biasing alone can provide some of the advantages described herein. FIG. 8 is a schematic diagram illustrating the stand-alone use of differential biasing in a system for detecting particles in accordance with certain embodiments. It will also be appreciated that in certain embodiments the elimination of a charge storage capacitor alone can provide some of the advantages described herein. A schematic diagram of such a circuit is shown in FIG. 9, in which a charge storage capacitor is eliminated in a system for detecting energetic particles.

EXEMPLARY EMBODIMENTS

In addition to the embodiments described elsewhere in this disclosure, exemplary embodiments of the present invention include, without being limited to, the following Embodiments:

1. A system for detecting particles comprising:

a detector unit including a differentially-biased detector having a first terminal for coupling to a positive bias voltage and a second terminal for coupling to a negative bias voltage; and an AC-coupler for coupling the detector to a measurement device with an input impedance Z0, the AC-coupler having capacitively-coupled input and output positive terminals and capacitively-coupled input and output negative terminals, wherein:

the capacitive couplings of the input and output positive and negative terminals are embedded in a transmission line structure with a surge impedance Z0, the input positive terminal is coupled to the first terminal of the detector, and the input negative terminal is coupled to the second terminal of the detector.

2. The system of embodiment 1, wherein the capacitive couplings of the input and output positive and negative terminals of the AC-coupler are the sole detector energy storage component.

3. The system of embodiment 1, further comprising a pulse compensation network connected in parallel with the detector.

4. The system of embodiment 2, further comprising a pulse compensation network connected in parallel with the detector.

5. A system for detecting particles comprising:

a detector having a first terminal for coupling to a positive bias voltage and a second terminal for coupling to a negative bias voltage; and an AC-coupler for coupling the detector to a measurement device with an input impedance Z0, the AC-coupler having capacitively-coupled input and output positive terminals and capacitively-coupled input and output negative terminals, wherein:

the capacitive couplings of the input and output positive and negative terminals are embedded in a transmission line structure with a surge impedance Z0, the input positive terminal is coupled to the first terminal of the detector, the input negative terminal is coupled to second terminal of the detector, and the capacitive couplings of the input and output positive and negative terminals of the AC-coupler are the sole detector energy storage component.

6. The system of embodiment 5, further comprising a pulse compensation network connected in parallel with the detector.

7. A system for detecting particles comprising:

a detector having a first terminal for coupling to a positive bias voltage and a second terminal for coupling to a negative bias voltage;

a pulse compensation network connected in parallel with the detector; and an AC-coupler for coupling the detector to a measurement device with an input impedance Z0, the AC-coupler having capacitively-coupled input and output positive terminals and capacitively-coupled input and output negative terminals, wherein:

the capacitive couplings of the input and output positive and negative terminals are embedded in a transmission line structure with a surge impedance Z0, the input positive terminal is coupled to the first terminal of the detector, and the input negative terminal is coupled to second terminal of the detector.

8. The system of any of embodiments 1-7, further comprising:

a first transmission line section of Z0 impedance coupling the AC-coupler to the detector unit; and a second transmission line section of Z0 impedance coupling the AC-coupler to the measurement device.

9. The system of embodiment 8, wherein one or both the first and second transmission line sections comprises multiple segments in a series connection.

10. The system of any of embodiments 1-9, comprising first and second resistors of substantially equal value for respectively coupling the first terminal of the detector to the positive bias voltage and the second terminal of the detector to the negative bias voltage in a differential bias mode.

11. The system of any of embodiments 3-4 or 6-7, wherein the pulse compensation network comprises a resistor of value Z0 in series with a capacitor of value within a factor of about 2 of the capacitive couplings of the input and output positive and negative terminals of the AC-coupler.

12. The system of any of embodiments 1-11, further comprising a first voltage source for providing the positive and negative bias voltages.

13. The system of embodiment 12, further comprising second and third voltage sources selectively couplable to the first voltage source, the second voltage source being of the same polarity as the first voltage source and the third voltage source being of opposite polarity of the first voltage source.

14. The system of any of embodiments 1-13, further comprising a measurement device with a load resistance coupled to the AC-coupler, wherein a high-pass impedance of the AC-coupler is matched to the load resistance and any transmission line impedance.

15. A method for detecting particles comprising:

impinging the particles on a differentially-biased detector having a first terminal for coupling to a positive bias voltage and a second terminal for coupling to a negative bias voltage; and coupling the detector to a measurement device with an input impedance Z0 using an AC-coupler having capacitively-coupled input and output positive terminals and capacitively-coupled input and output negative terminals, wherein:

the capacitive couplings of the input and output positive and negative terminals are embedded in a transmission line structure with a surge impedance Z0, the input positive terminal is coupled to the first terminal of the detector, and the input negative terminal is coupled to the second terminal of the detector.

16. The method of embodiment 15, further comprising using the capacitive couplings of the input and output positive and negative terminals of the AC-coupler as the sole detector energy storage component.

17. The method of embodiments 15 or 16, further comprising using a pulse compensation network connected in parallel with the detector.

18. A method for detecting particles comprising:

impinging the particles on a detector having a first terminal for coupling to a positive bias voltage and a second terminal for coupling to a negative bias voltage;

coupling the detector to a measurement device with an input impedance Z0 using an AC-coupler having capacitively-coupled input and output positive terminals and capacitively-coupled input and output negative terminals, wherein:

the capacitive couplings of the input and output positive and negative terminals are embedded in a transmission line structure with a surge impedance Z0, the input positive terminal is coupled to the first terminal of the detector, the input negative terminal is coupled to second terminal of the detector, and the capacitive couplings of the input and output positive and negative terminals of the AC-coupler are the sole detector energy storage component.

19. The method of embodiment 18, further comprising using a pulse compensation network connected in parallel with the detector.

20. A method for detecting particles comprising:

impinging the particles on a detector having a first terminal for coupling to a positive bias voltage and a second terminal for coupling to a negative bias voltage;

using a pulse compensation network connected in parallel with the detector; and coupling the detector to a measurement device with an input impedance Z0 using an AC-coupler having capacitively-coupled input and output positive terminals and capacitively-coupled input and output negative terminals, wherein:

the capacitive couplings of the input and output positive and negative terminals are embedded in a transmission line structure with a surge impedance Z0, the input positive terminal is coupled to the first terminal of the detector, and the input negative terminal is coupled to second terminal of the detector.

21. The method of any of embodiments 14-40, further comprising:

using a first transmission line section of Z0 impedance coupling the AC-coupler to the detector unit; and using a second transmission line section of Z0 impedance coupling the AC-coupler to the measurement device.

22. The method of embodiment 21, wherein one or both the first and second transmission line sections comprises multiple segments in a series connection.

23. The method of any of embodiments 14-22, further comprising first and second resistors of substantially equal value for respectively coupling the first terminal of the detector to the positive bias voltage and the second terminal of the detector to the negative bias voltage in a differential bias mode.

24. The method of any of embodiments 16-17 or 19-20, wherein the pulse compensation network comprises a resistor of value Z0 in series with a capacitor of value within a factor of about 2 of the capacitive couplings of the input and output positive and negative terminals of the AC-coupler.

25. The method of any of embodiments 14-24, further comprising a first voltage source for providing the positive and negative bias voltages.

26. The method of embodiment 25, further comprising second and third voltage sources selectively couplable to the first voltage source, the second voltage source being of the same polarity as the first voltage source and the third voltage source being of opposite polarity of the first voltage source.

27. The method of any of embodiments 14-16, further comprising a measurement device with a load resistance coupled to the AC-coupler, wherein a high-pass impedance of the AC-coupler is matched to the load resistance and any transmission line impedance.

29. The system of any of embodiments 1-4, further comprising a first resistor for coupling said first terminal of the detector to the positive bias voltage and a second resistor for coupling said second terminal of the detector to the negative bias voltage, to thereby provide said differential biasing.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted based on the foregoing description. This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

What is claimed is:

1. A system for detecting particles comprising:

a detector unit including a differentially-biased detector having a first terminal for coupling to a positive bias voltage and a second terminal for coupling to a negative bias voltage; and an AC-coupler for coupling the detector to a measurement device with an input impedance Z0, the AC-coupler having capacitively-coupled input and output positive terminals and capacitively-coupled input and output negative terminals, wherein:

the capacitive couplings of the input and output positive and negative terminals are embedded in a transmission line structure with a surge impedance Z0, the input positive terminal is coupled to the first terminal of the detector, and the input negative terminal is coupled to the second terminal of the detector.

2. The system of claim 1, wherein the capacitive couplings of the input and output positive and negative terminals of the AC-coupler are the sole detector energy storage component.

3. The system of claim 1, further comprising a pulse compensation network connected in parallel with the detector.

4. The system of claim 2, further comprising a pulse compensation network connected in parallel with the detector.

5. The system of claim 1, wherein the detector unit includes a first resistor coupling said first terminal of the detector to the positive bias voltage, and a second resistor for coupling said second terminal of the detector to the negative bias voltage, to thereby provide said differential biasing.

6. The system of claim 5, wherein the first and second resistors are of substantially equal value.

7. A system for detecting particles comprising:

a detector having a first terminal for coupling to a positive bias voltage and a second terminal for coupling to a negative bias voltage; and an AC-coupler for coupling the detector to a measurement device with an input impedance Z0, the AC-coupler having capacitively-coupled input and output positive terminals and capacitively-coupled input and output negative terminals, wherein:

the capacitive couplings of the input and output positive and negative terminals are embedded in a transmission line structure with a surge impedance Z0, the input positive terminal is coupled to the first terminal of the detector, the input negative terminal is coupled to second terminal of the detector, and the capacitive couplings of the input and output positive and negative terminals of the AC-coupler are the sole detector energy storage component.

8. The system of claim 7, further comprising a pulse compensation network connected in parallel with the detector.

9. A system for detecting particles comprising:

a detector having a first terminal for coupling to a positive bias voltage and a second terminal for coupling to a negative bias voltage;

a pulse compensation network connected in parallel with the detector; and an AC-coupler for coupling the detector to a measurement device with an input impedance Z0, the AC-coupler having capacitively-coupled input and output positive terminals and capacitively-coupled input and output negative terminals, wherein:

the capacitive couplings of the input and output positive and negative terminals are embedded in a transmission line structure with a surge impedance Z0, the input positive terminal is coupled to the first terminal of the detector, and the input negative terminal is coupled to second terminal of the detector.

10. The system of claim 1, further comprising:

a first transmission line section of Z0 impedance coupling the AC-coupler to the detector unit; and a second transmission line section of Z0 impedance coupling the AC-coupler to the measurement device.

11. The system of claim 10, wherein one or both the first and second transmission line sections comprises multiple segments in a series connection.

12. The system of claim 3, wherein the pulse compensation network comprises a resistor of value Z0 in series with a capacitor of value within a factor of about 2 of the capacitive couplings of the input and output positive and negative terminals of the AC-coupler.

13. The system of claim 1, further comprising a first voltage source for providing the positive and negative bias voltages.

14. The system of claim 13, further comprising second and third voltage sources selectively couplable to the first voltage source, the second voltage source being of the same polarity as the first voltage source and the third voltage source being of opposite polarity of the first voltage source.

15. A method for detecting particles, the method comprising:

coupling, with an AC coupler, a differentially-biased detector to a measurement device having an impedance Z0, the AC-coupler having capacitively-coupled input and output positive terminals and capacitively-coupled input and output negative terminals, wherein the capacitive couplings of the input and output positive and negative terminals are embedded in a transmission line structure with a surge impedance Z0, the input positive terminal is coupled to the first terminal of the detector, and the input negative terminal is coupled to the second terminal of the detector;

impinging the particles on the differentially-biased detector; and obtaining information about the particles from the measurement device.

16. A method for detecting particles in accordance with claim 15, the method further comprising:

connecting a pulse compensation network in parallel with the detector.

17. A method for detecting particles in accordance with claim 16, wherein the capacitive couplings of the input and output positive and negative terminals of the AC-coupler are the sole detector energy storage component.

18. A method for detecting particles in accordance with claim 15, wherein the capacitive couplings of the input and output positive and negative terminals of the AC-coupler are the sole detector energy storage component.

19. A method for detecting particles, the method comprising:

coupling, with an AC coupler, a detector to a measurement device having an impedance Z0, the AC-coupler having capacitively-coupled input and output positive terminals and capacitively-coupled input and output negative terminals, wherein the capacitive couplings of the input and output positive and negative terminals are embedded in a transmission line structure with a surge impedance Z0 and are the sole detector energy storage component, the input positive terminal is coupled to the first terminal of the detector, and the input negative terminal is coupled to the second terminal of the detector;

impinging the particles on the detector; and obtaining information about the particles from the measurement device.

20. A method for detecting particles in accordance with claim 19, the method further comprising:

connecting a pulse compensation network in parallel with the detector.

* * * * *